United States Patent [19]

Futcher

[11] 4,160,694

[45] Jul. 10, 1979

[54] TWIN WIRE WEB FORMING WITH WIRE TENSION CONTROL

[75] Inventor: Ralph J. Futcher, Beaconsfield, Canada

[73] Assignee: Dominion Engineering Works Limited, Lachine, Canada

[21] Appl. No.: 863,945

[22] Filed: Dec. 23, 1977

[51] Int. Cl.[2] ..... D21F 1/40; D21F 7/02

[52] U.S. Cl. ..... 162/256; 162/301

[58] Field of Search ..... 162/301, 273, 203, 256

[56] References Cited

U.S. PATENT DOCUMENTS

| | | | |
|---|---|---|---|
| 3,056,719 | 10/1962 | Webster | 162/203 |
| 3,565,757 | 2/1971 | Jordansson | 162/301 |
| 3,996,098 | 12/1976 | Kankaanpaa | 162/273 |

FOREIGN PATENT DOCUMENTS

| | | | |
|---|---|---|---|
| 731383 | 4/1966 | Canada. | |
| 2105613 | 8/1972 | Fed. Rep. of Germany | 162/301 |
| 469783 | 8/1975 | U.S.S.R. | 162/301 |

*Primary Examiner*—Richard V. Fisher

*Attorney, Agent, or Firm*—Raymond A. Eckersley

[57] ABSTRACT

A twin wire web forming machine suitable for making newsprint or slower draining grades of product is provided with a substantially continuously curving S-shaped formation and dewatering path, wherein one of the wires diverges from the web subsequent to passage through a formation zone lying about an arc of a first roll, a suction compartment within a couch roll at the point of wire divergence assuring continued adherence of the web to the remaining wire as it passes around the couch roll. A brake is controlled on the first roll to provide a predetermined value of wire tension.

4 Claims, 1 Drawing Figure

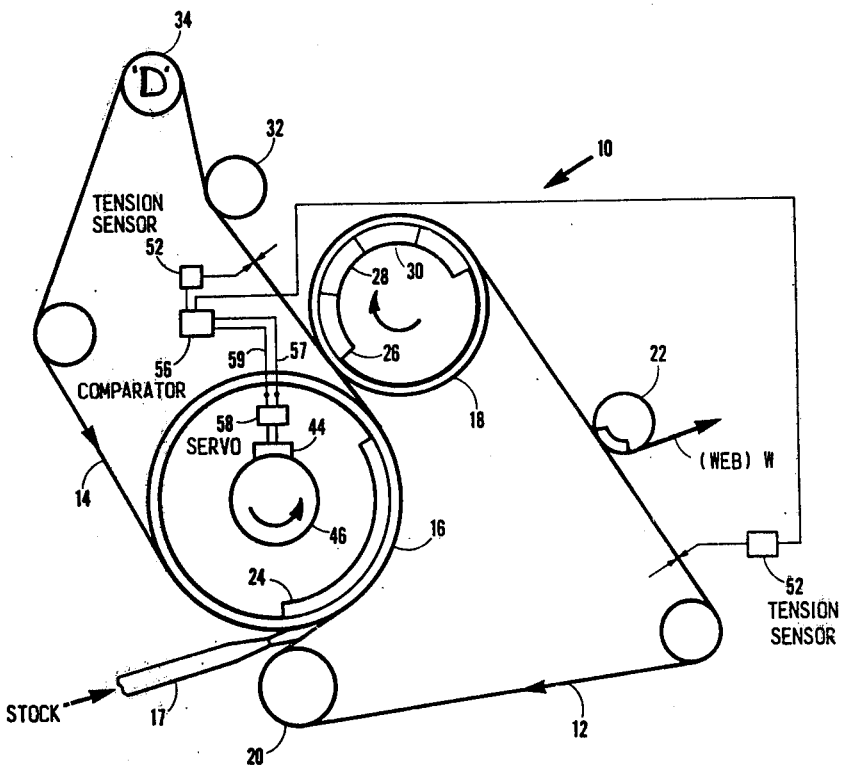
34
'D'
32
10
TENSION
SENSOR
52
28
30
56
59
57
26
22
COMPARATOR
58
44
SERVO
18
(WEB) W
14
46
16
24
52
TENSION
SENSOR
STOCK
17
20
12

TWIN WIRE WEB FORMING WITH WIRE TENSION CONTROL

BACKGROUND OF THE INVENTION

This invention is directed to twin wire web forming machines and in particular to a sinuous path web former suitable for use with grades of stock possessing slow to average draining rates.

There is in the paper making industry an extensively developed history of web formation using converging twin wire machines, commencing chronologically with cardboard manufacture, and leading up to present day high speed machines for manufacturing newsprint.

One such machine, known commercially as the "Papriformer" (Trademark) provides a substantially continuously curving sinuous or 'S' shaped path which is traversed by both of the wires in web sandwiching relation, as shown in Canadian Pat. No. 731,383 issued Apr. 5, 1966, de Montigny et al.

This continuously sinuous arrangement of the web forming wire path appears superficially like the arrangement shown in U.S. Pat. No. 3,565,757, Jordansson, Feb. 23, 1971 wherein FIG. 2 shows an intermediate extended straight path having a series of suction boxes underlying one of the wires; being located between oppositely-directed curved portions of the travel path of the two wires, where the web is trained around forming rolls. However, the dynamics of dewatering utilizing suction boxes and the extent and arrangement of the respective wire runs differ markedly between the two referenced arrangements, leading to significant differences in operational characteristics as well as first costs.

SUMMARY OF THE INVENTION

The present invention provides a twin wire web forming machine having a substantially continuously curved serpentine web path, wherein the web passes in sandwiched relation between the two wires through a substantially arcuately curved formation zone, one wire then diverging from the web as the web enters a path of reversed curvature, to permit sustained dewatering, including means to apply a pressure differential against the web at the point of wire divergence, by means of a vacuum compartment in a suction roll to assure continuance of the web along the serpentine path without the use of stationary vacuum devices that drag against the wires.

In accordance with the present invention the zone of web formation provides two sided dewatering, under the pressure of the two wires, together with centrifugal dewatering towards the radially outermost web face, while in the adjoining dewatering zone downstream from the formation zone the web is dewatered in the same direction as the previous centrifugal component, due to the suction applied to the innermost side of the web, which effects separation of the web from the wire at the zone of wire divergence. The applied suction is maintained beyond the point of wire separation and is applied through at least a portion of the arc of the remaining zone.

This machine is particularly advantageous for operation at lower speeds where the centrifugal effect is less pronounced. One advantage contemplated by the present invention is the use of a drive roll to drive the diverging wire. In the original "Papriformer" (T.M.) arrangement, owing to the wrapping of both wires about both the first or forming roll and the second or couch roll, which tends to create differential wire movement, it is not generally desireable to apply a drive to the wire lying radially outermost on the couch roll, due to possibly unacceptable levels of wet web shear that might be generated.

The present invention thus provides a twin wire web former having a pair of wires trained in mutually pressing relation about a forming roll and passing therefrom to a couch roll for passage of one wire in web supporting relation there-about, suction means within the couch roll to retain the web on the one wire, wire guide means to guide the other wire in divergent relation from the couch roll, first drive means for driving the former in web forming action, and variable loading means for varying the tension of one wire along one portion of the wire path through the former relative to the other wire.

DESCRIPTION OF THE DRAWING

Certain embodiments of the invention are described, reference being made to the accompanying drawing which shows a schematic side view of a machine constructed in accordance with the present invention.

DETAILED DESCRIPTION OF THE INVENTION

In the drawing the former 10 has a pair of so-called looped wires 12, 14, which may be of bronze fourdrinier wire or a suitable synthetic fabric. A breast roll 20 guides the first wire 12.

The forming roll 16 receives the two wires in mutually sandwiched relation about a forming zone defined by a suction box 24. A slice portion 17 from a headbox (not shown) introduces a jet of stock between the converging wires adjacent the breast roll.

The wires 12, 14 pass to a couch roll 18, where the outer wire 14 diverges from its contact with the web W. A suction box 26 in the couch roll serves to retain the web W on the wire 12 and an additional suction box or boxes 28, 30 etc. in the couch roll further dewater the web W through the wire 12.

The dewatered web W is taken off the first wire 12 by pick-up roll 22.

Guide rolls 32, 34 serve to guide the second wire 14 in diverging relation from the first wire 12.

It is contemplated that wire roll 34 would be driven 'D' to increase the tension in the run of the wire as it leaves the forming roll 16 such that the strain of both wires can be maintained at approximately the same level. The desired amount of wire strain is obtained by regulating the amount of drive torque input to the wire roll 34. At the same time, it may be necessary to provide for a controlled braking torque on the forming roll 16 by provision of a brake 44 acting on disc 46 to maintain steady speed condition for the system. By adjusting the torque applied by the combination of driving roll 34 and braking roll 16, the amount of strain can be adjusted to the appropriate level.

In the arrangement illustrated, tension sensors 52 monitor the respective off-going tensions of the wires 12, 14. The outputs of the respective sensors 52 are connected with differentiator 56, from which the output 57 is connected in controlling relation with the servo controller 58 of brake 44. A brake feedback 59 is provided to facilitate control of the system.

The tension sensing arrangement is primarily illustrative, and in fact the transverse loading of the rolls 22, 32 against the wires is or may be arranged to be a function of the tensions in the respective wires 12, 14 for the same portion of the wire runs served by the illustrated scheme.

Further particulars of tension rolls and wire guide rolls, being well known in the art, have been omitted.

In operation, the former may be controlled in part by varying the tension in the second wire 14, by braking roll 16 in conjunction with driving roll 34 in order to achieve differential loading of the twin wires and minimize the effects of web wet shear produced by differential movement between the two wires.

While a disc brake 44 is illustrated schematically, in combination with a wire tension sensing and differentiating arrangement for controlling relative wire tensions, the use of a regenerative brake on forming roll 16, together with selective control to vary the relative energization of driving roll 32 and forming roll 16 to provide differential wire loading also is contemplated.

Certain advantages of the improved former, in addition to reduction in the tendency to produce wet web shear, comprises:

elimination of positive pressure boxes within the couch roll 18, with consequent diminution in the generation of spray, and simplification of water and vapour savealls associated with the couch roll;

reduction in the complexity of the couch roll 18, with the number of compartments therein being reducible to one or two, with consequent cost reduction and friction load diminution;

elimination of the need to contain the web W beneath the outer wire 14 for passage about the couch roll, permitting the wrap of the wire 14 about roll 18 to be significantly reduced, with consequent simplification in the wire path and reduction in wire tension; reduction in the tension in the top wire 14, leads to reduced wire forces and hence to reduced roll sizes, or conversely to relatively reduced roll deflections, under wire loading.

The simplified water handling of the system fosters satisfactory running of the machine at lower speeds, which is beneficial for heavier grades of stock and different formations such as corrugated board.

What I claim as new and desire to secure by Letters Patent of the United States is:

1. In a twin-wire web forming machine having a first endless forming belt and a second endless forming belt arranged in converging relation therewith; headbox means to feed stock in sandwiched relation between the converging belts; a first roll located within the loop of the first belt to receive the first and second belts in tensioned pressing relation about a portion of the periphery of the roll to provide an initial web formation zone, a second roll located within the loop of the second belt, to guide the second belt in diverging relation from the first belt, said second roll having a suction compartment therein adjacent the point of divergence of said belts to assist retention of said web on said second belt, belt drive means within said first loop to draw said first belt in tensioned relation from said first roll, brake means operating on said first roll in load applying relation, and brake control means to provide a predetermined value of tension to said first belt.

2. The machine as claimed in claim 1 wherein said first roll is a suction roll having suction box means therein to provide a predetermined degree of suction to said web.

3. The machine as claimed in claim 1, including belt tension sensing means to sense the tension of at least one said belt in off-going relation from one said roll, means connecting said tension sensing means in controlling relation with said brake means.

4. The machine as claimed in claim 1, including belt tension sensing means located at an off-going portion of each said belt, tension comparator means to differentiate said belt tensions, and brake control means responsive to said comparator means to control said brake to provide a predetermined difference in tension between said belts.

* * * * *